United States Patent [19]

Adams et al.

[11] Patent Number: 4,895,090

[45] Date of Patent: Jan. 23, 1990

[54] LOST MOTION COMPENSATION FOR SEWING MACHINE NEEDLE VIBRATING GATE

[75] Inventors: Kenneth D. Adams, Madison; John Blackwood, Union, both of N.J.

[73] Assignee: SSMC Inc., Fairfield, N.J.

[21] Appl. No.: 308,572

[22] Filed: Feb. 10, 1989

[51] Int. Cl.[4] ..... D05B 3/02

[52] U.S. Cl. ..... 112/443; 112/221

[58] Field of Search ..... 112/443, 221

[56] References Cited

U.S. PATENT DOCUMENTS

| | | | |
|---|---|---|---|
| 2,853,964 | 9/1958 | Zylbert | 112/443 |
| 2,856,874 | 10/1958 | Odermann | 112/443 |
| 4,123,983 | 11/1978 | Transue | 112/221 |
| 4,436,043 | 3/1984 | Cantada | 112/221 |
| 4,441,441 | 4/1984 | Bianchi | 112/221 |

*Primary Examiner*—Andrew M. Falik

*Attorney, Agent, or Firm*—Theodore Jay

[57] ABSTRACT

A zig zag sewing machine needle bar gate mounted to accommodate thermal expansion on spaced bearings of which one comprises a spherical bearing arranged in a cylindrical bushing bore and with a spring clip biasing the spherical bearing against the bushing bore to compensate for lost motion.

4 Claims, 1 Drawing Sheet

LOST MOTION COMPENSATION FOR SEWING MACHINE NEEDLE VIBRATING GATE

BACKGROUND OF THE INVENTION

This invention relates to the construction of sewing machine needle vibrating gates which are mounted so as to impart lateral zig zag stitch forming movements to the sewing machine needle. More particularly this invention relates to such needle bar gate construction provided with clearances to accommodate thermal expansion and wear of the parts, and a novel lost motion compensating arrangement for eliminating backlash and adverse influence on the zig zag stitch forming movements due to clearances in the needle bar gate mounting.

DESCRIPTION OF THE PRIOR ART

It has been known, as disclosed in U.S. Pat. No. 2,856,874, Oct. 21, 1958 of Odermann and U.S. Pat. No. 2,853,964, Sept. 30, 1958 of Zylbert, to spring bias the needle bar gate of a sewing machine in one direction of its lateral vibratory movement so as to minimize backlash and lost motion. The disadvantages of such known arrangements, however, are the imposition of relatively high frictional forces on the drive devices influencing needle jogging motion and the favouring of that direction of needle jogging motion toward which the spring biasing force is directed.

SUMMARY OF THE INVENTION

It is the object of this invention to provide a sewing machine needle vibrating gate construction with clearances length wise of the axis of vibration primarily to accommodate thermal expansion of the parts and radically of the vibration axis primarily to accomodate wear of the parts. It is also an object of this invention to provide a lost motion compensating arrangement for eliminating backlash as well as adverse influence on the fidelity of zig zag stitch patterns due to such clearances.

These objects are attained by a mounting for the needle bar gate including at one extremity a spherical bearing axially constrained between socket halves secured in the sewing machine frame, and at the other extremity spherical bearing arranged in a cylindrical bushing bore oriented concentric with the axis of vibration of the needle bar gate. Compensation for eliminating backlash is attained in this invention by the use of a "V" shaped spring clip having one arm arranged in a bore formed axially in the spherical bearing within the cylindrical bore of the bushing, and the other spring arm constrained externally of the bushing so as to bias the spherical bearing into point contact with the interior wall of the cylindrical bushing bore.

DESCRIPTION OF THE DRAWING

With the above and additional objects and advantages in new, as will hereinafter appear, this invention will now be described with reference to the accompanying drawing of a preferred embodiment in which.

DETAILED DESCRIPTION

Figure 1:
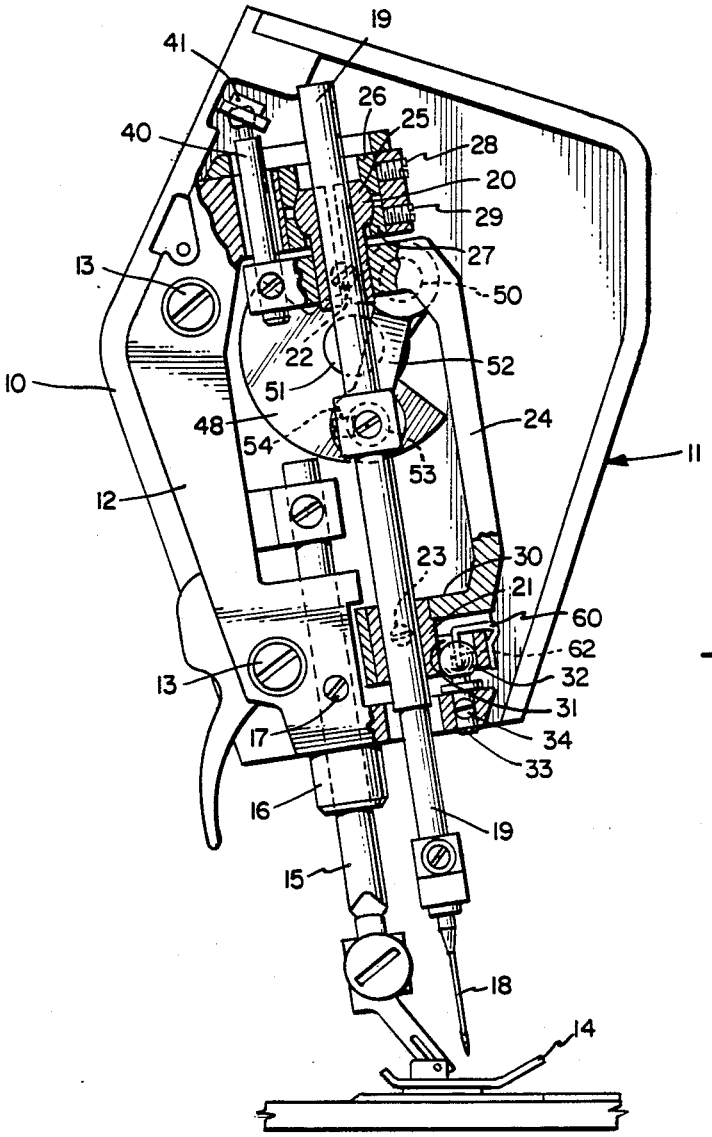
FIG. 1 is a head end elevational view of a sewing machine including a needle bar vibrating gate with lost motion compensating means in accordance with this invention.
Figure 2:
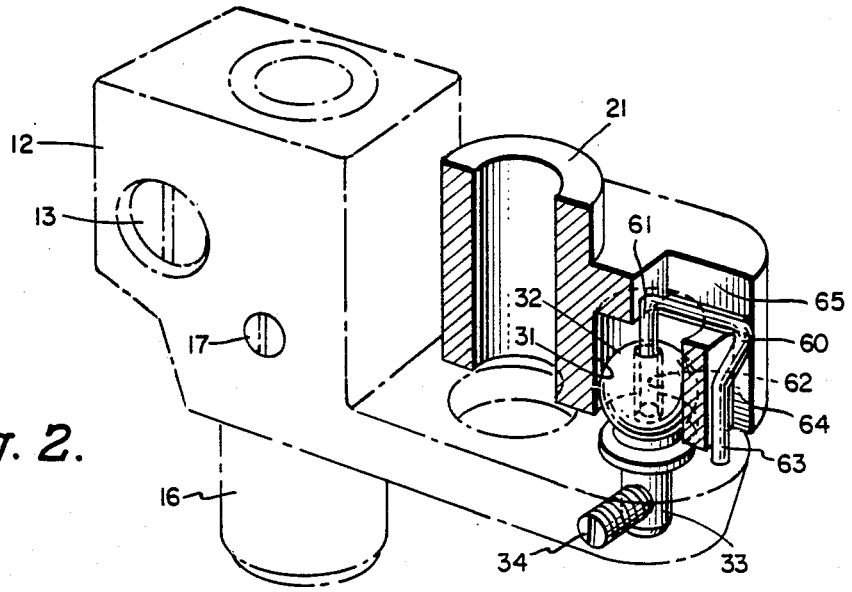
FIG. 2 is an enlarged perspective view of a portion of the needle bar gate mounting means of FIG. 1 partly in cross section and illustrating the lost motion compensating means of this invention.

Referring to FIG. 1, there is shown the head end frame portion 10 of a sewing machine 11 with the head end cover removed to expose the arrangement of internal parts, portions of which are illustrated in cross section. A support bracket 12 for the stitch forming instrumentalities carried within the head end portion 10 is secured to the sewing machine frame as by screws 13. The stitching forming instrumentalities carried within the head end portion 10 include a presser foot 14 secured on a presser bar 15 which is endwise shiftable in a bushing 16 secured by screw 17 in this support bracket 12.

The stitch forming instrumentalities in the head end portion also include a thread carrying needle 18 secured to a needle bar 19.

In order that the needle 18 may partake of both endwise reciprocatory stitch forming movement and also lateral jogging movement to form zig zag stitches, the needle bar 19 is endwise reciprocable in spaced bearing members 20 and 21 each secured as by set screws 22 and 23, respectively, in a needle bar gate 24.

The upper bearing member 20 is arranged to form a needle bar accomdating bore with a spherically shaped extremity 25 substantially coaxial with the needle bar axis and constrained axially of the needle bar between socket halves 26 and 27 each secured as by set screws 28 and 29, respectively, in the support bracket 12.

The lower bearing member 21 includes a lateral extension or bushing 30 formed with a cylindrical bore 31 located on an axis spaced from that of the needle bar 19 and preferably oriented in alignment with the center of the spherical extremity 25 of the upper bearing member 20. The cylindrical bore 31 accommodates the spherical head 32 of a bearing stud 33 which is fixed as by a force fit set screw 34 or the like in the support bracket 12.

The spherical head 32 of the bearing stud 33 and the spherical extremity 25 of the upper bearing member 20 define an axis of oscillation in the sewing head 10 for the needle bar gate 24, which axis diverges from that of the needle bar 19.

For oscillating the needle bar gate 24 a post 40 is supported thereon and may be connected to a driving arm 41 which may be impelled by any of a variety of devices known in the sewing machine art to influence lateral jogging of the needle as is required to product zig zag stitches and the formation of ornamental stitch patterns.

The needle bar 19 may be reciprocated endwise by any conventional means as by a crank pin 50 driven by the sewing machine main shaft 51. A connecting link 52 extends between the crank pin 50 and a stud 53 which is secured on the needle bar by a screw 54.

Because the upper bearing member 20 is constrained axially between the socket halves 26 and 27, any thermal expansion of the needle bar gate 24 or any difference in thermal expansion as between the needle bar gate and the suppport bracket 12 will be accomodated by a shift of the cylindrical bore 31 in the lower needle bar gate bearing 21 relatively to the spherical head 32 of the bearing stud 33. Since this freedom of relative movement is provided, the danger of binding or excessive clearance due to thermal expansion is eliminated.

Lost motion and any adverse influence upon the lateral jogging movements imparted to the needle which might be occasioned by clearance between the spherical head 32 of the bearing stud 33 and the cylindrical bore 31 in the needle bar gate bearing 21 is effectively compensated by a "V" shaped spring 60, one arm 61 of which extends into an axial cavity 62 formed in the spherical head 32 of the bearing 33.

The other arm 63 of the spring 60 extends into engagement exteriorly of the bearing member 21 preferably in a groove 64 formed therein to constrain the spring arm 63.

The needle bar gate 24 may be formed with a slot 65 to accommodate insertion or removal of spring 60. The action of spring 60 in biasing the spherical bearing head 32 into point contact with the cylindrical bore 31 thus eliminates lost motion due to clearance between these parts and compensates for any wear that may occur in these bearing surfaces. Since the frictional forces developed by this spring loading are applied at the extremely small radius of the bearing head 32, no significant loading will be applied on the driving device impelling the driving arm 41 for imparting needle jogging control. Moreover the groove 64 constraining the spring arm 63 may be arranged so as to orient the spring 60 so as to locate the point contact between the spherical head 32 and the cylindrical bore 31 directly opposite the path of lateral needle bar jogging movement so that the biasing force exerted by the spring 60 does not favor either direction of needle jogging motion, and therefore, no adverse distortion on zig zag stitch patterning will occur as result of such spring force.

Having set forth the nature of this invention, what is claimed herein is:

1. A zig zag sewing machine needle jogging mechanism including a needle carrying bar endwise reciprocable in a needle bar gate, spaced bearings pivotally supporting said needle bar gate in said sewing machine on an axis divergent from that said needle bar, one of said spaced bearings comprising a sewing machine supported stud having a spherical extremity and a bushing on said needle bar gate formed with a cylindrical stud accommodating bore on an axis coincident with that of said needle bar gate, and spring means acting between said one bearing components biasing said spherical stud extremity into point contact with said cylindrical bore to eliminate backlash in oscillatory movement of said needle bar gate.

2. A zig zag sewing machine needle jogging mechanism as set forth in claim 1 in which the bushing of said one of the spaced needle bar gate bearings includes a needle bar accommodating bore spaced from said cylindrical stud accommodating bore, and the other of said needle bar gate bearings comprises a bushing formed coaxially with an internal needle bar accommodating bore and with an external spherical segment, and bearing socket halves secured in said sewing machine and arranged in engagement with opposite sides of the spherical segment of said other needle bar gate bearing.

3. A zig zag sewing machine needle jogging mechanism as set forth in claim 1 in which the spherical extremity of said one of the spaced bearings is formed with an axial cavity, in which said spring means is of substantially "U" shape including one spring arm engaged in said axial cavity in said spherical bearing extremity and the other spring arm engaging the bushing of said one of the spaced bearings externally of said cylindrical stud accommodating bore therein.

4. A zig zag sewing machine needle jogging mechanism as set forth in claim 2 in which the spherical extremity of said one of the spaced bearings is formed with an axial cavity, in which said spring means is of substantially "U" shape including one spring arm engaged in said axial cavity in said spherical bearing extremity and the other spring arm engaging the bushing of said one of the spaced bearings externally of said cylindrical stud accommodating bore therein, and in which the bushing of said one of the spaced bearings is formed externally of said cylindrical stud accommodating bore with a groove accommodating the other spring arm of said spring means in a position locating the point contact between said spherical stud extremity and said cylindrical bore directly opposite said needle bar accommodating bore in said bushing.

* * * * *